US011661730B2

(12) United States Patent
Yau

(10) Patent No.: US 11,661,730 B2
(45) Date of Patent: May 30, 2023

(54) ENVIRONMENTALLY-FRIENDLY HOT WATER DELIVERY SYSTEM

(71) Applicant: Daisy S. Yau, Burlingame, CA (US)

(72) Inventor: Daisy S. Yau, Burlingame, CA (US)

( * ) Notice: Subject to any disclaimer, the term of this patent is extended or adjusted under 35 U.S.C. 154(b) by 184 days.

(21) Appl. No.: 16/882,483

(22) Filed: May 24, 2020

(65) Prior Publication Data

US 2021/0363739 A1 Nov. 25, 2021

(51) Int. Cl.
*E03D 1/32* (2006.01)
*F24D 19/10* (2006.01)

(52) U.S. Cl.
CPC ..... *E03D 1/32* (2013.01); *F24D 19/1051* (2013.01)

(58) Field of Classification Search
CPC ..... E03D 1/32
USPC ..... 4/252.1, 643; 285/56, 64
See application file for complete search history.

(56) References Cited

U.S. PATENT DOCUMENTS 2,995,759 A * 8/1961 Gentry ..... E03D 9/08 4/420.1
4,876,750 A * 10/1989 Broyles ..... E03D 9/085 4/444
5,647,069 A * 7/1997 Han ..... E03D 9/08 4/420.4
5,839,129 A * 11/1998 Lee ..... E03D 9/08 4/420.4
5,987,659 A * 11/1999 Cannizzaro ..... E03D 9/085 4/420.4
6,327,994 B1 * 12/2001 Labrador ..... B63B 39/06 114/382
10,428,504 B2 * 10/2019 Chen ..... F24H 9/1809
2003/0213850 A1 * 11/2003 Mayer ..... G05D 23/1393 236/12.12
2005/0144713 A1 * 7/2005 Lim ..... E03D 9/085 4/420.4
2007/0209102 A1 * 9/2007 Lim ..... A47K 4/00 4/420.4
2008/0134423 A1 * 6/2008 Ding ..... E03D 9/08 4/420.2
2010/0180368 A1 * 7/2010 West, Jr. ..... A47K 11/023 4/111.1
2011/0044671 A1 * 2/2011 Amiran ..... F24H 9/2021 392/441
2013/0025039 A1 * 1/2013 Armstrong ..... E03D 9/00 4/255.06
2013/0232685 A1 * 9/2013 Cornille ..... A47K 4/00 4/663
2013/0263366 A1 * 10/2013 Prete ..... A47K 13/307 4/209 R (Continued)

*Primary Examiner* — Lori L Baker

(57) ABSTRACT

A joint connects to a hot water source, a toilet tank of a toilet, and a hot water outlet. A set of pipes connecting the hot water source and the joint may be referred to herein as "main hot water pipes." Water exiting the hot water source into the main hot water pipes is above a desired water temperature. As time passes, however, water that rests in the main hot water pipes may fall below the desired water temperature. Rather than wasting all of the cooled water resting in the main hot water pipes in order to use hot water at the hot water outlet, at least a portion of the cooled water may be used to refill the toilet tank. Therefore less cooled water exits the hot water outlet before fresh water reaches the hot water outlet.

20 Claims, 11 Drawing Sheets

(56) References Cited

U.S. PATENT DOCUMENTS

| | | | | |
|---|---|---|---|---|
| 2016/0010878 | A1* | 1/2016 | Lee | F24D 19/1051 700/300 |
| 2018/0023276 | A1* | 1/2018 | Puskas | A47K 10/48 4/444 |
| 2018/0171614 | A1* | 6/2018 | Chen | F24H 1/207 |
| 2022/0074175 | A1* | 3/2022 | Caban | F24D 19/1051 |

* cited by examiner

ENVIRONMENTALLY-FRIENDLY HOT WATER DELIVERY SYSTEM

TECHNICAL FIELD

The present disclosure relates to plumbing systems. In particular, the present disclosure relates to environmentally-friendly hot water delivery systems.

BACKGROUND

A single hot water source generally serves multiple hot water outlets. Examples of hot water sources include water heater tanks and instant hot water heaters. Examples of hot water outlets include a hot water faucet at a sink, a hot water faucet at a bathtub, a hot water inlet for a washing machine, and a hot water inlet for a dishwasher.

Various pipes route water from the hot water source to the hot water outlets. The length of the pipes from the hot water source to a particular hot water outlet generally varies based on the distance between the hot water source and the particular hot water outlet. A greater length of pipes is required to route water from the hot water source to a farther hot water outlet.

Water exiting a hot water source is above a desired threshold value and therefore considered "hot." However, water resting in pipes connecting a hot water source and a hot water outlet cools towards environmental temperature. When a hot water outlet is turned on, hot water exits the hot water source into the pipes. Meanwhile, cooled water originally resting in the pipes exits the pipes and flows out from the hot water outlet. Only after the cooled water exits the hot water outlet does the hot water reach the hot water outlet. Since a user generally desires to use hot water at a hot water outlet, the cooled water being flushed out is generally wasted. The greater the length of the pipes between the hot water source and the hot water outlet, the greater volume of cooled water resting in the pipes that needs to be flushed out.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

BRIEF DESCRIPTION OF THE DRAWINGS

The embodiments are illustrated by way of example and not by way of limitation in the figures of the accompanying drawings. It should be noted that references to "an" or "one" embodiment in this disclosure are not necessarily to the same embodiment, and they mean at least one. In the drawings.

DETAILED DESCRIPTION

Figure 1:
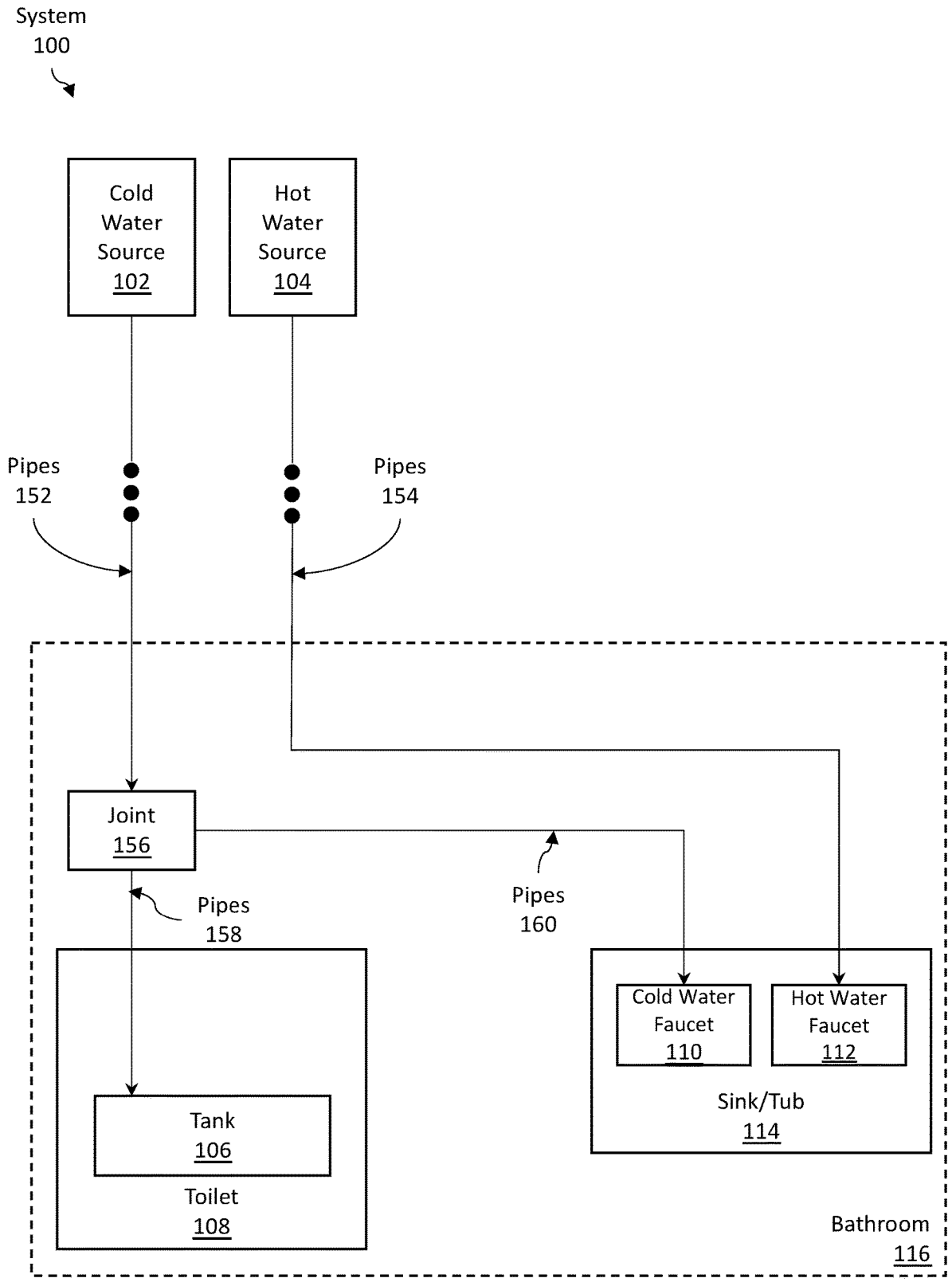
FIG. 1 (Prior Art)
FIG. 1 illustrates an example prior art hot water delivery system.

In the following description, for the purposes of explanation, numerous specific details are set forth in order to provide a thorough understanding. One or more embodiments may be practiced without these specific details. Features described in one embodiment may be combined with features described in a different embodiment. In some examples, well-known structures and devices are described with reference to a block diagram form in order to avoid unnecessarily obscuring the present invention.

1. GENERAL OVERVIEW
2. HOT WATER DELIVERY SYSTEM ARCHITECTURE
3. TOILET TANK VALVE
4. DELIVERING HOT WATER
5. EXAMPLE EMBODIMENTS
6. HARDWARE OVERVIEW
7. MISCELLANEOUS; EXTENSIONS

1. GENERAL OVERVIEW

One or more embodiments include a joint connected to (a) a hot water source, (b) a toilet tank of a toilet, and (c) a hot water outlet. A set of pipes connecting the hot water source and the joint may be referred to herein as "main hot water pipes." Using the joint, the main hot water pipes are configured to deliver hot water to both the toilet tank and the hot water outlet. The toilet tank and the hot water outlet may but are not necessarily be located in a same physical environment (such as a bathroom). Water exiting the hot water source into the main hot water pipes is above a desired water temperature. As time passes, however, water that rests in the main hot water pipes cools towards environmental temperature and may fall below the desired water temperature. Water that originated from a hot water source and remains above the desired water temperature may be referred to herein as "fresh water." Water that originated from a hot water source but falls below the desired water temperature may be referred to herein as a "cooled water." The joint allows any cooled water resting in the main hot water pipes to flow towards the toilet tank. Hence rather than flushing out all of the cooled water in the main hot water pipes at the hot water outlet, at least a portion of the cooled water may be used to refill the toilet tank. Therefore less cooled water exits the hot water outlet before fresh water reaches the hot water outlet. Moreover a shorter wait time is needed before fresh water reaches the hot water outlet.

One or more embodiments include a valve configured to control a level of water flowing towards a toilet tank from a hot water source and/or a level of water flowing towards the toilet tank from a cold water source. When a user flushes the toilet, and expects to use the hot water at the hot water outlet shortly thereafter, the valve is set to pass water from the hot water source towards the toilet tank. Based on the valve setting, at least a portion of any cooled water resting in a set of main hot water pipes is used to fill the toilet tank, as described above. Therefore water-saving and time-saving benefits are achieved, as described above. However, when usage of hot water is not expected at the hot water outlet, the valve is set to pass water from the cold water source towards the toilet tank. Passing cold water to the toilet tank avoids unnecessarily filling the main hot water pipes with fresh water when hot water is not desired. Therefore energy-saving benefits are also achieved.

One or more embodiments include a smart controller configured to set a valve that controls a level of water flowing towards a toilet tank from a hot water source and/or a level of water flowing towards the toilet tank from a cold water source. The smart controller includes an artificial intelligence (AI) module that predicts whether hot water is desired at a hot water outlet. The AI module may be trained based on historical data indicating a set of times at which hot water was previously desired at the hot water outlet. If a user uses the toilet, and usage of hot water shortly thereafter is predicted, then the smart controller sets the valve to pass water from the hot water source towards the toilet tank. Based on the valve setting, at least a portion of any cooled water resting in a set of main hot water pipes is used to fill the toilet tank, as described above. Additionally or alternatively, the smart controller includes a temperature sensor. The temperature sensor detects a water temperature of water at a particular location (for example, the joint connecting the hot water source, the toilet tank, the hot water outlet, and/or any location along the main hot water pipes) along a set of plumbing components connecting the hot water source and the toilet tank. If the detected water temperature is above the desired water temperature, then the smart controller sets the valve to pass water from the cold water source towards the toilet tank (even if usage of hot water is expected at the hot water outlet). Passing cold water towards the toilet tank avoids unnecessarily filling the main hot water pipes with additional fresh water, when the main hot water pipes already holds a sufficient volume of fresh water.

One or more embodiments described in this Specification and/or recited in the claims may not be included in this General Overview section.

2. HOT WATER DELIVERY SYSTEM ARCHITECTURE

FIG. 1 illustrates an example prior art hot water delivery system. As illustrated in FIG. 1, a system 100 includes a cold water source 102, a hot water source 104, a toilet 108, a toilet tank 106, a sink and/or tub 114, a cold water faucet 110, a hot water faucet 112, pipes 152, 154, 158, 160, and a joint 156. In one or more embodiments, the system 100 may include more or fewer components than the components illustrated in FIG. 1.

In one or more embodiments, a cold water source 102 is a source of water that is at environmental temperature, such as the temperature of a storage location, resting location, and/or other environmental of the water. A cold water source 102 supplies water that is below a water temperature that users expect for "hot water."

In one or more embodiments, a hot water source 104 is a source of water that is above a water temperature that users expect for "hot water," which may also be referred to herein as "desired water temperature." A hot water source 104 may use gas, electricity, fuel, solar energy, and/or other energy forms to heat water from an environmental temperature to or above a desired water temperature. Additionally or alternatively, a hot water source 104 may use gas, electricity, fuel, solar energy, and/or other energy forms to retain water at or above a desired water temperature. Examples of hot water sources include a water boiler, a hot water tank, and an instant hot water heater.

In one or more embodiments, a cold water outlet is an outlet for water that is below a desired water temperature. Examples of hot water outlets include a cold water faucet 110 at a sink and/or tub 114, a cold water inlet for a laundry machine, and a cold water inlet for a dishwasher.

In one or more embodiments, a hot water outlet is an outlet for water that is above a desired water temperature. Examples of hot water outlets include a hot water faucet 112 at a sink and/or tub 114, a hot water inlet for a laundry machine, and a hot water inlet for a dishwasher.

In one or more embodiments, a toilet 108 includes a water-flushed receptacle, used for defecation and urination. A toilet includes a toilet tank 106 that holds water used for flushing the toilet 108.

In one or more embodiments, a pipe (such as pipes 152, 154, 158, 160) is a tube of metal, plastic, or other material used to convey water or other fluid substances. As illustrated, pipes 152 connect cold water source 102 and joint 156. Pipes 158 connect joint 156 and tank 106 of toilet 108. Pipes 160 connect joint 156 and cold water faucet 110. Pipes 154 connects hot water source 104 and hot water faucet 112. As used herein, the term "connect" may refer to directly connect and/or indirectly connect. For example, while pipes 152 is illustrated as being in contact with cold water source 102, there may be other components that are not illustrated between cold water source 102 and pipes 152. Further, as used herein, the term "main cold water pipes" refers to a set of pipes connecting a cold water source and a joint that further connects to multiple usage locations of cold water (such as, a cold water inlet of a toilet tank and a cold water outlet).

In one or more embodiments, a joint 156 includes three or more openings, each opening to be connected to a pipe or other plumbing component. A joint 156 may be used to manipulate the conveyance of fluid through a set of pipes. A joint 156 divides fluid flow from one connection into multiple other connections. Additionally or alternatively a joint 156 combines fluid flow from multiple connections into one other connection. A joint 156 may be in any of a variety of shapes, such as a t-shape or y-shape. As illustrated, joint 156 is configured to pass water from a cold water source 102 towards at least a toilet tank 106 and a cold water outlet (such as a cold water faucet 110).

In one or more embodiments, the term "plumbing component" refers to any component in a plumbing system. Examples of plumbing components include a pipe, joint, valve, hot water source, cold water source, hot water outlet, cold water outlet, and toilet tank.

As illustrated, a toilet 108 and a sink 114 are located within a same physical environment, such as a bathroom 116. A cold water source 102 and a hot water source 104 may be located away from the bathroom 116. The ellipses of pipes 152 represent a routing of pipes 152 between the cold water source 102 and the joint 156 that is lengthy and/or complex due to the physical distance between the cold water source 102 and the joint 156, the physical layout of a building requiring pipes 152 to be routed in a certain way, and/or other factors. The ellipses of pipes 154 represent a routing of pipes 154 between the hot water source 104 and the hot water faucet 112 that is lengthy and/or complex due to the physical distance between the hot water source 104 and the hot water faucet 112, the physical layout of a building requiring pipes 154 to be routed in a certain way, and/or other factors.

In the prior art, water from only the cold water source 102 is delivered to the toilet tank 106. Water from the hot water source 104 is not delivered to the toilet tank 106.

Pipes 152 deliver water from the cold water source 102 to the bathroom 116 (or a location that is closer to the bathroom 116 than the cold water source 102). Pipes 152 are connected to a joint 156, which divides the water for use in different outlets, such as a toilet tank 106 and a cold water faucet 110. Pipes 158 deliver water from the joint 156 to the toilet tank 106. Pipes 160 deliver water from the joint 156 to the cold water faucet 110. Since the toilet tank 106 and the cold water faucet 110 are within the same bathroom 116, the length of pipes 158 and the length of pipes 160 are generally shorter than the length of pipes 152.

Pipes 154 deliver water from the hot water source 104 to the bathroom 116, and to the hot water faucet 112. Water exiting the hot water source 104 into pipes 154 may be above a desired water temperature. If there is no water flow, however, water that rests in pipes 154 cools towards environmental temperature and may fall below the desired water temperature. Water that originated from a hot water source and remains above the desired water temperature may be referred to herein as "fresh water." Water that originated from a hot water source but falls below the desired water temperature may be referred to herein as a "cooled water." All of the cooled water resting in pipes 154 must be flushed out in order for fresh water from the hot water source 104 to reach the hot water faucet 112. The only way to flush out the cooled water is through the hot water faucet 112 (or possibly other hot water faucets that are not illustrated). Since the length of pipes 154 may be very long, a large amount of cooled water is wasted from the hot water faucet 112 before hot water reaches the hot water faucet 112.

FIGS. 2A-D illustrate various example hot water delivery systems, in accordance with one or more embodiments.

Figure 2A:
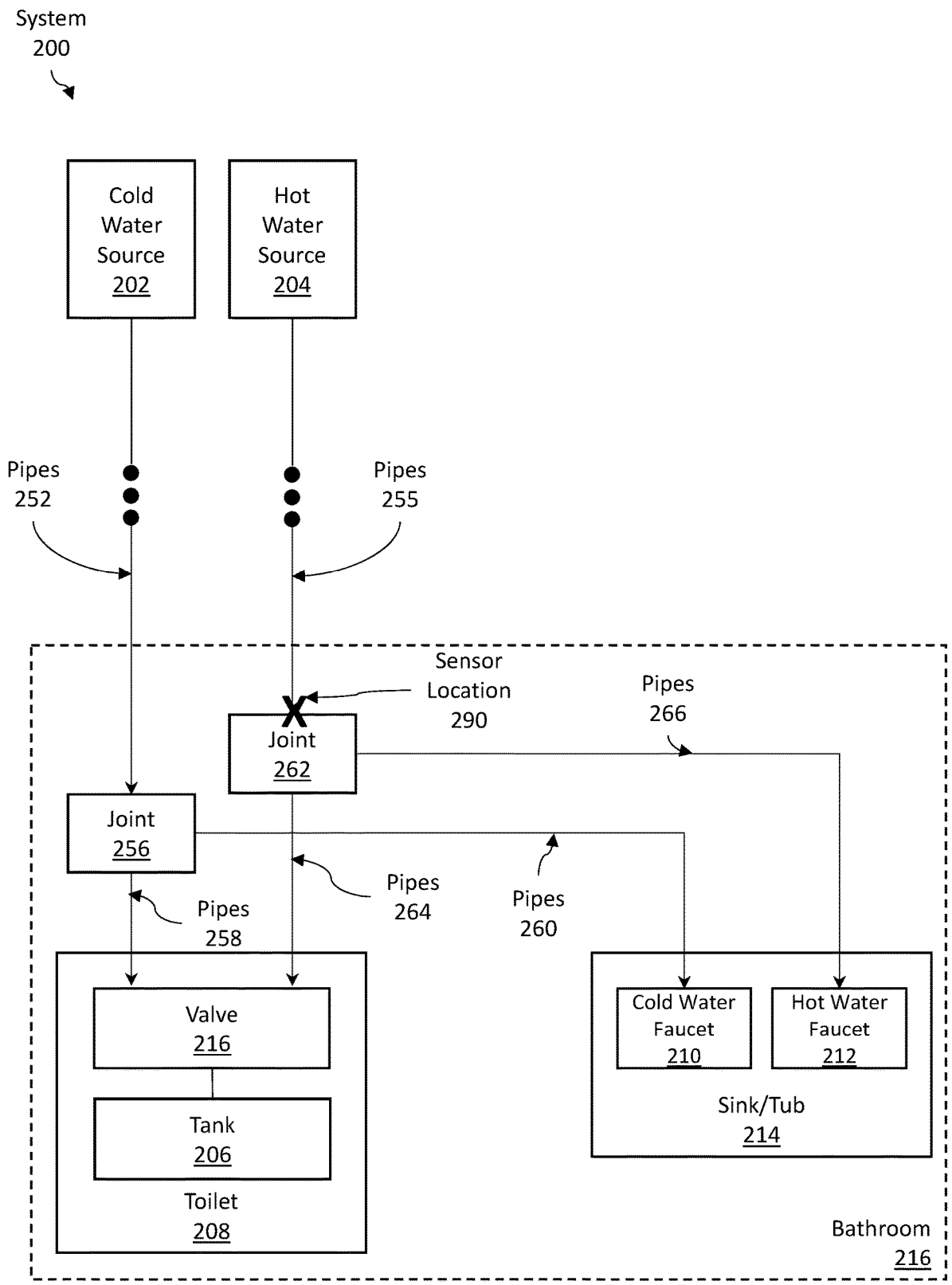
FIGS. 2A-D illustrate various example hot water delivery systems, in accordance with one or more embodiments.
Figure 2B:
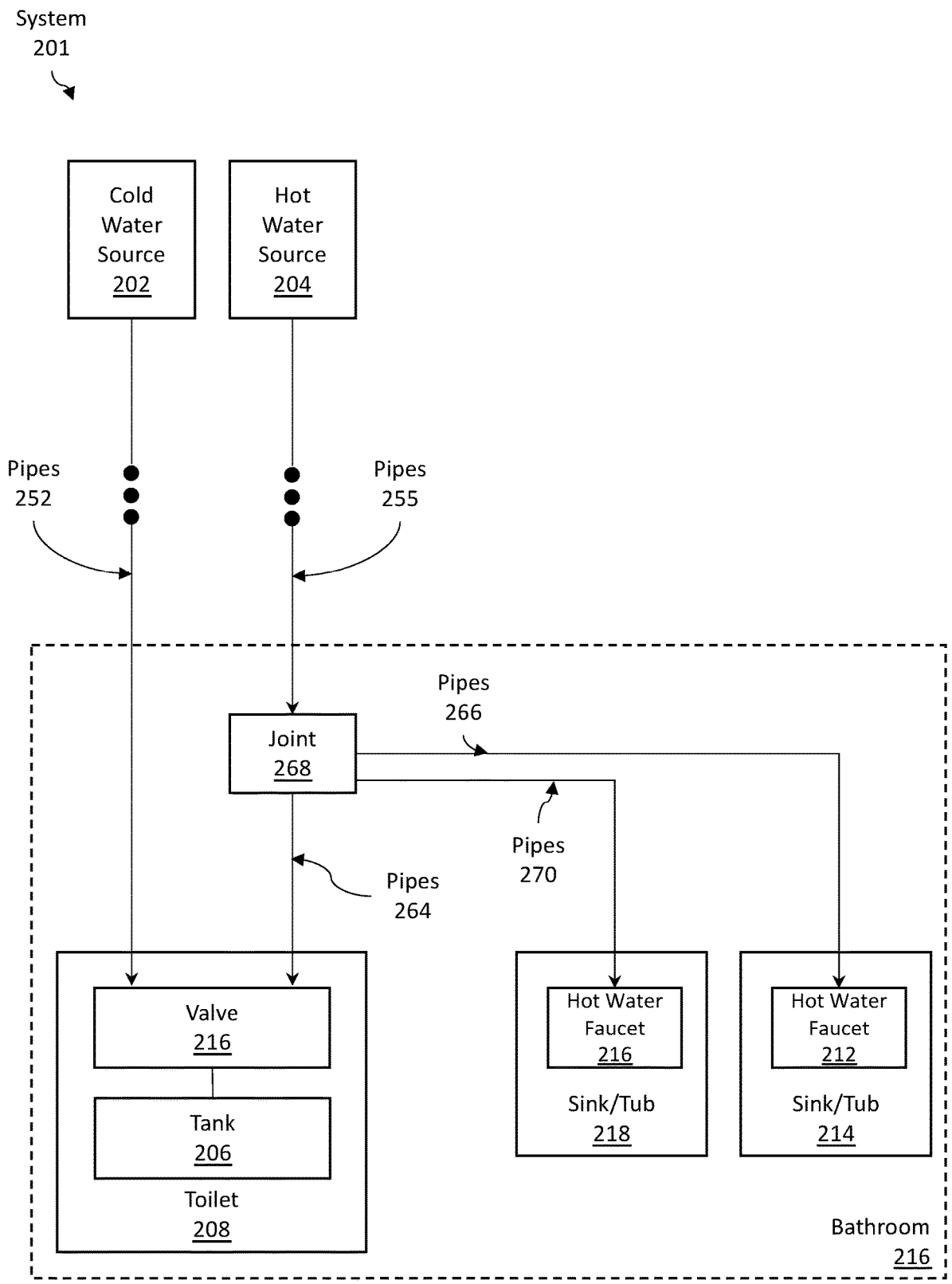
Figure 2C:
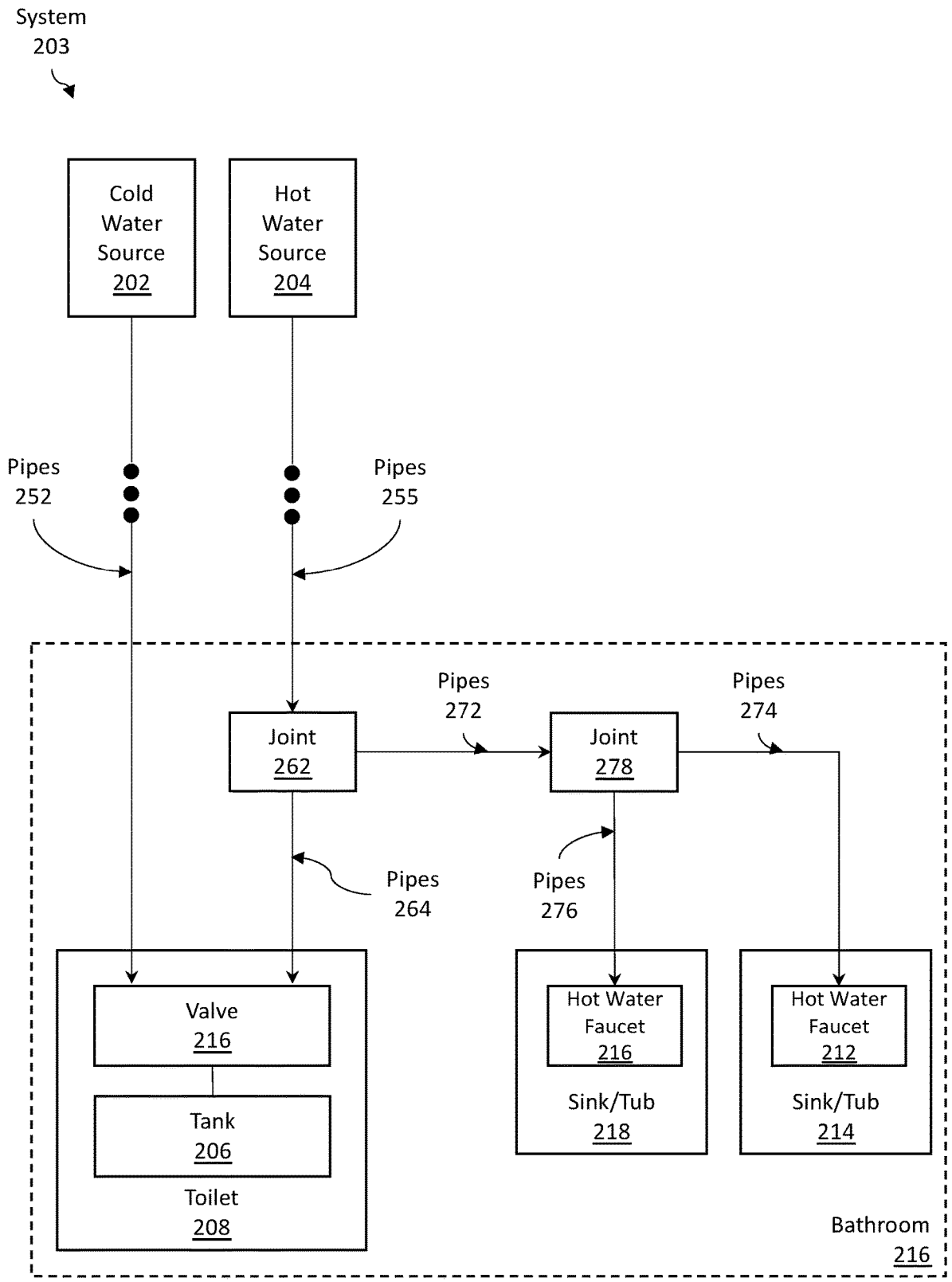
Figure 2D:
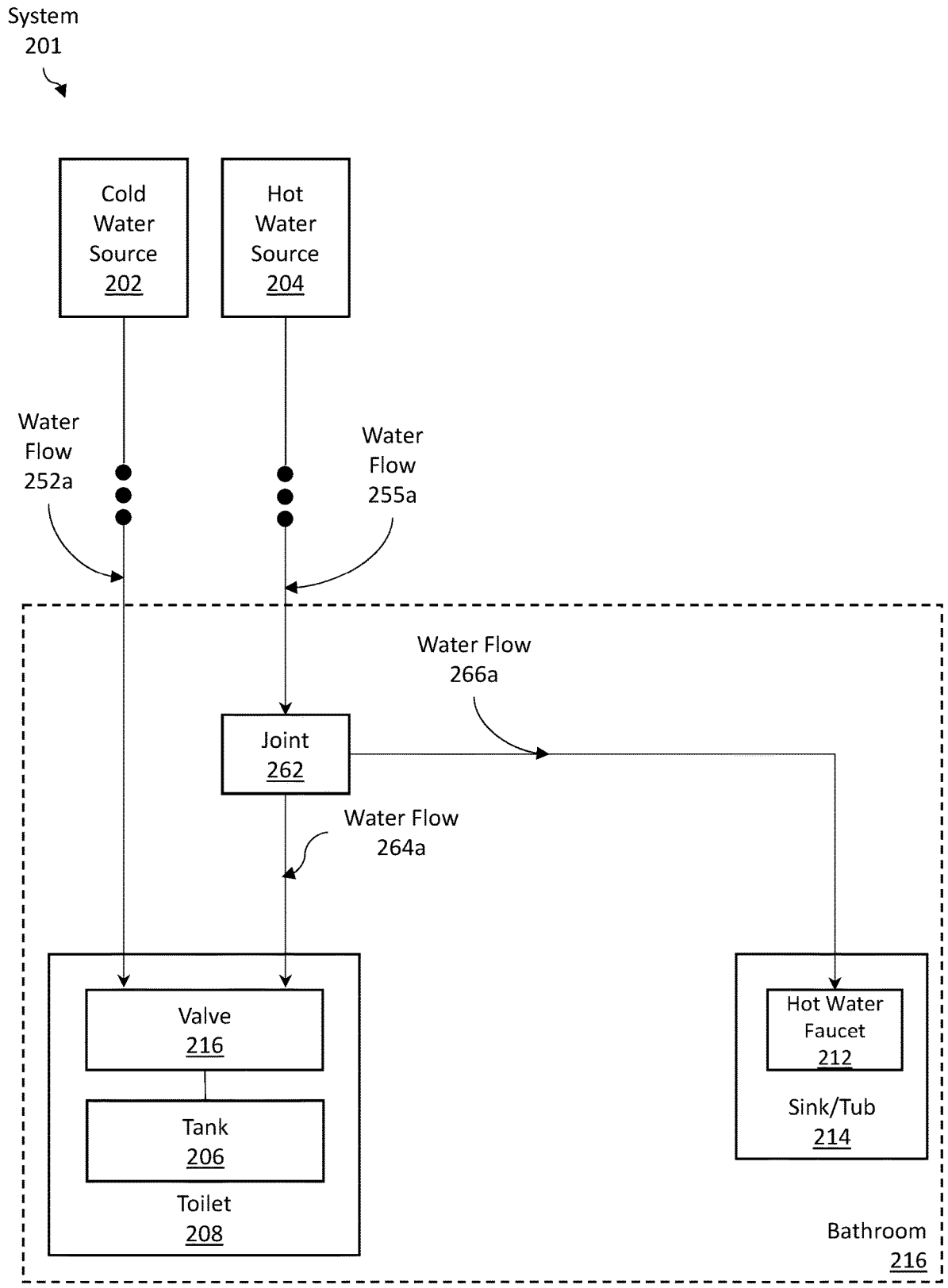

As illustrated in FIGS. 2A-C, each of systems 200, 201, and 203 includes a cold water source 202, a hot water source 204, a toilet 208, a toilet tank 206, a valve 216, a sink and/or tub 214, a cold water faucet 210, a hot water faucet 212, pipes 252, 255, 258, 260, 264, and a joint 256. In one or more embodiments, the systems 200, 201, and 203 may include more or fewer components than the components illustrated in FIGS. 2A-C.

Similarly numbered components across FIGS. 1 and 2A-C are similar to each other. Bathroom 216 is similar to bathroom 116. Cold water source 202 is similar to cold water source 102. Hot water source 204 is similar to hot water source 104. Toilet 208 is similar to toilet 108. Tank 206 is similar to tank 106. Sink and/or tub 214 is similar to sink and/or tub 114. Cold water faucet 210 is similar to cold water faucet 110. Hot water faucet 212 is similar to hot water faucet 112. Pipes 252 are similar to pipes 152. Pipes 258 are similar to pipes 158. Pipes 260 are similar to pipes 160.

Comparing FIG. 1 and FIG. 2A, water from a hot water source 204 is now deliverable to a toilet tank 206. In particularly, a joint 262 has been added. Like joint 256, joint 262 manipulates the conveyance of fluid through a set of pipes. As illustrated, joint 256 is configured to pass water from a hot water source 204 towards at least a toilet tank 206 and a hot water outlet (such as a hot water faucet 212). In particular, the hot water source 204 is connected to pipes 255; pipes 255 is connected to the joint 262; the joint 262 is connected to pipes 266; and pipes 266 is connected to the hot water faucet 212.

In an embodiment, pipes 255 of FIG. 2A are similar to a portion of pipes 154 that delivers water from the hot water source 204 to the bathroom 216 (or a location that is closer to the bathroom 216 than the hot water source 204). Pipes 255 and pipes 154 may be similarly lengthy and/or complex due to the physical distance between a hot water source and an end point, the physical layout of a building requiring certain routing, and/or other factors. As used herein, the term "main hot water pipes" refers to a set of pipes connecting a hot water source and a joint that further connects to multiple usage locations of hot water (such as, a hot water inlet of a toilet tank and a hot water outlet). As explained above, a pipe is a tube of metal, plastic, or other material used to convey water or other fluid substances. Hence, referring to FIGS. 2A and 2D together, pipes 252 and/or pipes 258 of FIG. 2A carry water flow 252*a* of FIG. 2D; pipes 255 of FIG. 2A carry water flow 255*a* of FIG. 2D; pipes 264 of FIG. 2A carry water flow 264*a* of FIG. 2D; pipes 266 of FIG. 2A carry water flow 266*a* of FIG. 2D.

As described above with reference to FIG. 1, water exiting the hot water source 204 into pipes 255 may be above a desired water temperature. If there is no water flow, water that rests in pipes 255 cools towards environmental temperature. The duration of time that fresh water, resting in a set of pipes 255 between a hot water source 204 and a joint 262, remains above a desired water temperature may be referred to herein as a "critical time period." After the critical time period, the water resting in pipes 255 falls below the desired water temperature and becomes "cooled water." All of the cooled water resting in pipes 255 must be flushed out in order for new fresh water from the hot water source 204 to reach the hot water faucet 112. However, rather than flushing out the cooled water through the hot water faucet 212, a portion (or all) of the cooled water may now flow through the joint 262 and into the toilet tank 206. The cooled water may be used for flushing the toilet 208.

In an embodiment, the joint 262 is located closer to the hot water faucet 212 than the hot water source 204. Hence, the length of pipes 255 is longer than the length of pipes 266. Hence, pipes 255 hold a larger volume of water than pipes 266. Hence, if water resting within pipes 255 and pipes 266 has cooled, a larger portion of the cooled water may flow through the joint 262 and into the toilet tank 206. Meanwhile, only a smaller portion of the cooled water needs to flow through the hot water faucet 212 and thereby potentially be wasted. In an embodiment, a sensor configured to detect water temperature is located at sensor location 290, which is located at the joint 262. Sensor location 290 serves as an example of where the sensor may be located; the sensor may alternatively be located at any location along a set of plumbing components connecting the hot water source and the toilet tank. Further descriptions relating to a sensor are below with reference to FIGS. 3A-3B and 5.

According to the system 200, cooled water resting in pipes 255 is made useful by being delivered to and stored in the toilet tank 206. There is no need to recirculate any cooled water back to the hot water source 204. The joint 262 does not pass water towards the hot water source 204.

Comparing FIG. 1 and FIG. 2A, a valve 216 has also been added. In one or more embodiments, a valve 216 includes three or more openings, each opening to be connected to a pipe or other plumbing component. Like a joint, a valve 216 may be used to manipulate the conveyance of fluid through a set of pipes. A valve 216 is configurable to control a level of fluid that flows into any of the openings and/or a level of fluid that flows out of any of the openings.

As illustrated, valve 216 is connected to (a) the toilet tank 206, (b) the hot water source 204 (through the joint 262), and (c) the cold water source 202. Valve 216 is configured to control a level of water flowing towards the toilet tank 206 from the hot water source 204 and a level of water flowing towards the toilet tank 206 from the cold water source 202. For example, valve 216 may be configured to pass all water towards the toilet tank 206 from the hot water source 204 and not from the cold water source 202. Additionally or alternatively, valve 216 may be configured to pass 75 percent of water towards the toilet tank 206 from the hot water source 204 and 25 percent of water towards the toilet tank 206 from the cold water source 202.

In an embodiment, a building and/or structure may include a water delivery system similar to the system 100 of FIG. 1. Converting the water delivery system into the system 200 of FIG. 2 requires merely an addition of the joint 262 and pipes 264. In particular, along the length of pipes 154, a particular location is selected for adding the joint 262. The portion of the pipes 154 after the joint 262 is referred to as "pipes 266." Any cooled water resting in pipes 266 cannot flow towards the tank 206 (since the water in pipes 266 is already passed the point of the joint 262) and therefore must exit through the hot water faucet 212. Hence, the closer the location of the joint 262 to the hot water faucet 212, the shorter the distance of pipes 266, and the lesser amount of cooled water potentially exiting the hot water faucet 212. The joint 262 is connected to pipes 264, which are connected to the tank 206. Optionally, converting the water delivery system into the system 200 of FIG. 2 may also include adding the valve 216.

Turning to FIGS. 2B-C, more than one hot water outlet may benefit from the delivery of water from the hot water source 204 to the toilet tank 206. FIGS. 2B-C include an additional sink and/or tub 218, which utilizes a hot water faucet 216.

As illustrated in FIG. 2B, a joint 268 has been added. Like joint 256, joint 268 manipulates the conveyance of fluid through a set of pipes. Joint 268 is configured to pass water from a hot water source 204 towards at least a toilet tank 206 and two hot water outlets (such as a hot water faucet 212 and a hot water faucet 216). In particular, the hot water source 204 is connected to pipes 255; pipes 255 is connected to the joint 268; the joint 262 is connected to pipes 266 and pipes 270; pipes 266 is connected to the hot water faucet 212; and pipes 270 is connected to the hot water faucet 216. The joint 268 is configured to pass water from the hot water source 204 towards the toilet tank 206, the hot water faucet 212, and the hot water faucet 216. Hence, whether hot water is desired at the hot water faucet 212 or the hot water faucet 216, any cooled water resting within the pipes 255 may be passed to the toilet tank 206. Therefore, a reduced amount (or none at all) of cooled water that was resting in the pipes 255 needs to exit from either of the hot water faucets 212, 216.

As illustrated in FIG. 2C, the joint 262 is still used, but a joint 278 has been added. Like joint 256, joint 278 manipulates the conveyance of fluid through a set of pipes. Joint 262 is configured to pass water from the hot water source 204 towards at least a toilet tank 206 and joint 278. Joint 278 is configured to pass water from joint 262 towards at least the hot water faucet 212 and the hot water faucet 216. Hence, whether hot water is desired at the hot water faucet 212 or the hot water faucet 216, any cooled water resting within the pipes 255 may be passed to the toilet tank 206. Therefore, a reduced amount (or none at all) of cooled water that was resting in the pipes 255 needs to exit from either of the hot water faucets 212, 216.

3. TOILET TANK VALVE

Figure 3A:
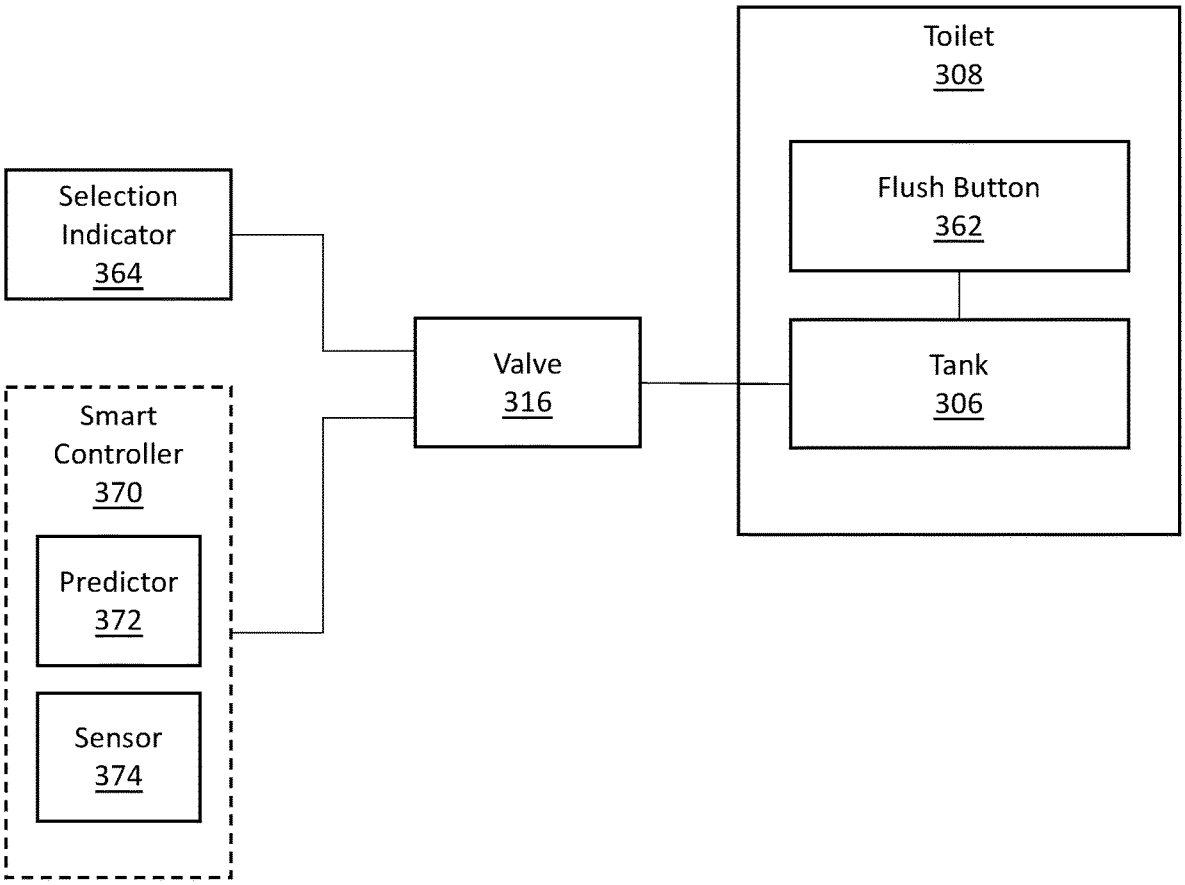
FIGS. 3A-B illustrate example toilets with valves controlling water levels from different sources, in accordance with one or more embodiments.
Figure 3B:
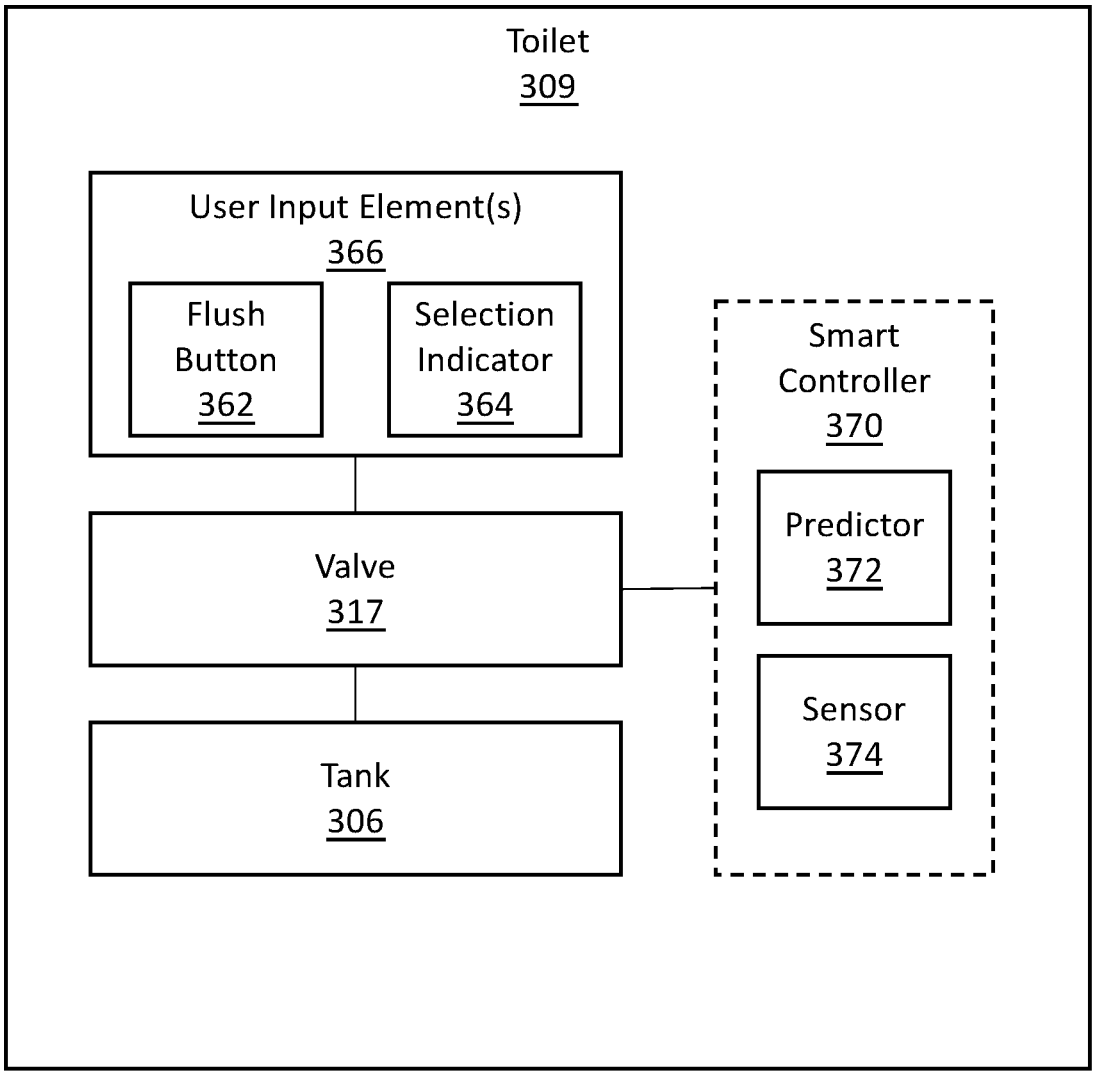

FIGS. 3A-B illustrate example toilets with valves controlling water levels from different sources, in accordance with one or more embodiments.

FIG. 3A illustrates a toilet 308, as used in the prior art, to be incorporated into the systems 200, 201, and/or 203 of FIGS. 2A-C. The toilet 308 includes a flush button 362 and a tank 306. The flush button 362 is configured to receive a user indication to flush the toilet 308. Only the plumbing components leading to the inlet of the tank 306 need be modified. In particular, pipes connecting to a hot water source (rather than to a cold water source) may be routed to the inlet of the tank 306. Alternatively, a valve 316 may be added. The valve 316 connects both the cold water source and the hot water source to the inlet of the tank 306. Valve 316 of FIG. 3A is similar to valve 216 of FIG. 2. As described above, valve 316 controls levels of water entering the tank 306 from a cold water source and a hot water source. Meanwhile, water entering the tank 306 from the hot water source passes through a joint, which is also connected to a hot water outlet. A set of pipes connecting the hot water source and the joint may be referred to as "main hot water pipes."

In one or more embodiments, a valve 316 is set based on a selection indicator 364 and/or a smart controller 370. A selection indicator 364 includes a user interface that facilities communications between a user and a valve 316. A selection indicator 364 includes one or more user interface elements for receiving user indications and/or user input. Examples of user interfaces include touch screens, buttons, graphical user interfaces (GUI), and voice interfaces.

A selection indicator 364 is configured to receive a user indication indicating whether hot water is desired at a hot water outlet within a critical time period. As described above, a critical time period is a maximum duration of time in which fresh water that exited from a hot water source and rests in a set of pipes remains above a desired water temperature. If the user indicates that hot water is desired within the critical time period, then the valve is set to allow water from the hot water source to fill the tank 306. Hence, at least a portion of cooled water resting in a set of main hot water pipes may flow towards the tank 306. When hot water is requested at the hot water outlet within the critical time period, fresh water from the hot water source may reach the hot water outlet more quickly.

Additionally or alternatively, a selection indicator 364 is configured to receive a user indication indicating a level of water for entry into the tank 306 from a cold water source and/or a level of water for entry into the tank 306 from a hot water source. A user indication indicating that water for entry into the tank 306 should be taken from the hot water source also indicates that the user desires to use hot water at a hot water outlet within a critical time period.

When hot water is desired at the hot water outlet, all or a certain percentage of water for entry into the tank 306 may be taken from the hot water source. The percentage of water to take from the hot water source may be set such that the volume of water entering into the tank 306 from the hot water source is equal to the volume of water held by the main hot water pipes. Therefore, all water resting in the main hot water pipes passes into the tank 306, but no (or minimal) fresh water from the hot water source passes into the tank 306. Energy for heating fresh water is hence reserved for water actually used at the hot water outlet, rather than wasted on water used for filling the tank 306.

A smart controller 370 refers to hardware and/or software configured to set a valve that controls levels of water for entry into the tank 306 from a hot water source and a cold water source. A smart controller 370 includes a predictor 372 and a sensor 374. Examples of operations for setting a valve based on predicting hot water usage at a hot water outlet are further described below with reference to FIG. 5. Examples of operations for setting a valve based on detecting a water temperature along the pipes between a hot water source and a toilet tank are also further described below with reference to FIG. 5.

In an embodiment, a smart controller 370 is implemented on one or more digital devices. The term "digital device" generally refers to any hardware device that includes a processor. A digital device may refer to a physical device executing an application or a virtual machine. Examples of digital devices include a computer, a tablet, a laptop, a desktop, a netbook, a server, a web server, a network policy server, a proxy server, a generic machine, a function-specific hardware device, a mainframe, a mobile handset, a smartphone, and/or a personal digital assistant (PDA).

In an embodiment, a smart controller 370 is coupled to one or more data repositories. A data repository is any type of storage unit and/or device (e.g., a file system, database, collection of tables, or any other storage mechanism) for storing data. Further, a data repository may include multiple different storage units and/or devices. The multiple different storage units and/or devices may or may not be of the same type or located at the same physical site. Further, a data repository may be implemented or executed on the same computing system as a smart controller 370. Alternatively or additionally, a data repository may be implemented or executed on a computing system separate from a smart controller 370. The data repository may be communicatively coupled to the smart controller 370 via a direct connection or via a network. A data repository may store information, such as, a desired water temperature, an artificial intelligence (AI) module (further described below), a machine learning algorithm, training data, historical data, a detected water temperature, and/or a comparison algorithm.

A predictor 372 predicts whether hot water is desired at a hot water outlet within a critical time period. The predictor 372 makes the prediction using an artificial intelligence (AI) module. The valve 316 is set based on the prediction determined by the predictor 372.

In an embodiment, an AI module may be trained using machine learning and/or other algorithms. A machine learning algorithm is an algorithm that can be iterated to learn a target model f (such as an AI module) that best maps a set of input variables to an output variable, using a set of training data. The training data includes datasets and associated labels. The datasets are associated with input variables for the target model f. The associated labels are associated with the output variable of the target model f. The training data may be updated based on, for example, feedback on the accuracy of the current target model f. Updated training data is fed back into the machine learning algorithm, which in turn updates the target model f.

A machine learning algorithm 114 generates a target model f such that the target model f best fits the datasets of training data to the labels of the training data. Additionally or alternatively, a machine learning algorithm 114 generates a target model f such that when the target model f is applied to the datasets of the training data, a maximum number of results determined by the target model f matches the labels of the training data. Different target models be generated based on different machine learning algorithms and/or different sets of training data.

A machine learning algorithm may include supervised components and/or unsupervised components. Various types of algorithms may be used, such as linear regression, logistic regression, linear discriminant analysis, classification and regression trees, naïve Bayes, k-nearest neighbors, learning vector quantization, support vector machine, bagging and random forest, boosting, backpropagation, and/or clustering.

Examples of operations for training an AI module are further described below with reference to FIG. 6.

A sensor 374 detects a water temperature of water at a particular location along the pipes connecting the hot water source and the toilet tank. The particular location may be, for example, the joint connecting the hot water source to the toilet tank and the hot water outlet, the valve connecting the hot water source and the cold water source to the toilet tank, and/or the toilet tank itself. If the detected water temperature is greater than the desired water temperature, then at least some volume of water resting in the pipes has not cooled below the desired water temperature. Therefore, regardless of whether hot water is desired at the hot water outlet (based on user indication and/or prediction), there is no need for entry of additional fresh water into the pipes. The valve 316 is set to pass water from the cold water source towards the tank 306. Conversely, if the detected water temperature is below the desired water temperature, then the valve is set to pass water from the hot water source towards the tank 306. Hence, the valve is set based on a comparison of the detected water temperature and the desired water temperature.

FIG. 3B illustrates a toilet 309 designed for use in the systems 200, 201, and/or 203 of FIGS. 2A-C. The toilet 309 includes one or more user input elements 366, a valve 317, a tank 306, and a smart controller 370.

In one or more embodiments, a valve 317 is incorporated as part of the toilet 309. Valve 317 of FIG. 3B is similar to valve 216 of FIG. 2. As described above, valve 317 controls levels of water entering the tank 306 from a cold water source and a hot water source. Meanwhile, water entering the tank 307 from the hot water source passes through a joint, which is also connected to a hot water outlet. Hence, the toilet 309 has at least two inlets: one inlet for connecting to the cold water source, and the other inlet for connecting to the hot water source.

In one or more embodiments, a smart controller 370 as described above is incorporated as part of the toilet 309. The smart controller 370 is configured to set the valve 317.

In one or more embodiments, a user input element 366 is configured to receive a user indication. User input elements 366 include a flush button 362 and a selection indicator 364, as described above with reference to FIG. 3A. In one or more embodiments, a single user input element is used to perform at the functions of a flush button 362 and a selection indicator 364. As an example, a user input element may include a rotatable handle. If the handle is not rotated, then the toilet 309 is not flushed. If the handle is rotated to the left, then the toilet 309 is flushed using water from a cold water source. If the handle is rotated to the right, then the toilet 309 is flushed using water from a hot water source. As another example, a user input element may include a pair of buttons. If no buttons are pushed, then the toilet 309 is not flushed. If the left button is pushed, then the toilet 309 is flushed using water from a cold water source. If the right button is pushed, then the toilet 309 is flushed using water from a hot water source.

4. DELIVERING HOT WATER

Figure 4:
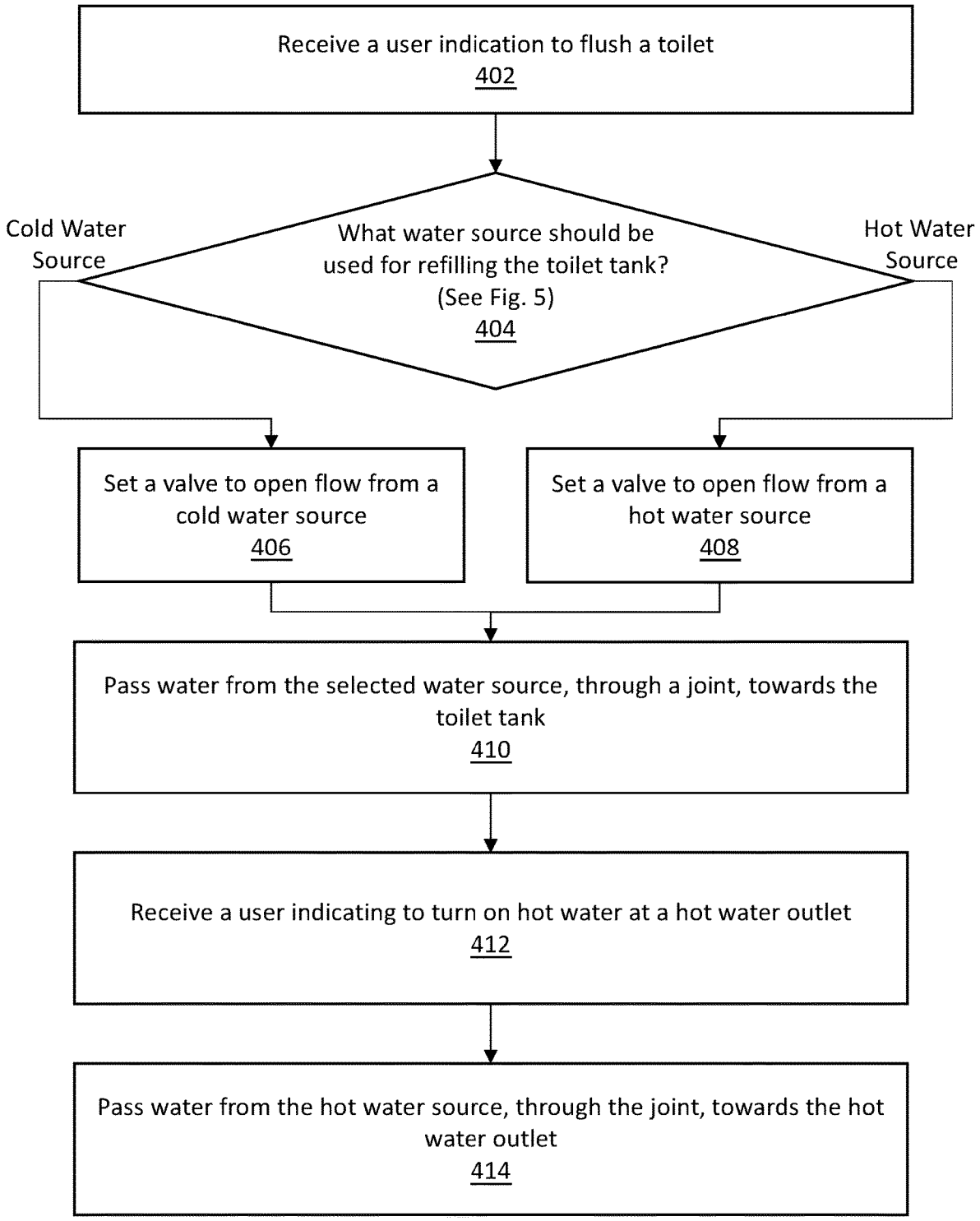
FIG. 4 illustrates an example set of operations for delivering water from a hot water source to a hot water outlet, in accordance with one or more embodiments.

FIG. 4 illustrates an example set of operations for delivering water from a hot water source to a hot water outlet, in accordance with one or more embodiments. One or more operations illustrated in FIG. 4 may be modified, rearranged, or omitted all together. Accordingly, the particular sequence of operations illustrated in FIG. 4 should not be construed as limiting the scope of one or more embodiments.

One or more embodiments include receiving a user indication to flush a toilet (Operation 402). A user interface element receives a user indication to flush a toilet. As an example, a handle is rotated to indicate flushing a toilet. As another example, a button is pressed to indicate flushing a toilet.

One or more embodiments include determining what water source should be used for refilling the toilet tank (Operation 404). Examples of operations for determining what water source should be used for refilling the toilet tank are further described below with reference to FIG. 5.

If water from a cold water source should be used for refilling the toilet tank, one or more embodiments include setting a valve to open a flow from the cold water source (Operation 406). Based on the valve, water may flow from the cold water source, through a set of main cold water pipes, through a joint, and towards the toilet tank.

If water from a hot water source should be used for refilling the toilet tank, one or more embodiments include setting a valve to open a flow from the hot water source (Operation 408). Based on the valve, water may flow from the hot water source, through a set of main hot water pipes, through a joint, and towards the toilet tank.

In an embodiment, a percentage of water used for refilling the toilet tank is from a cold water source, and the remainder of the water used for refilling the toilet tank is from a hot water source. In this case, the valve passes water from both the cold water source and the hot water source. The valve controls a level of water passing from the cold water source and a level of water passing from the hot water source.

One or more embodiments include passing water from the selected water source, through a joint, towards the toilet tank (Operation 410). Responsive to the opening of the valve, water is passed from the selected water source towards the toilet tank. Passing water from the selected water source towards the toilet tank includes moving water that was originally resting in a set of pipes towards the toilet tank.

If the hot water source was selected, water resting in the main hot water pipes moves towards the toilet tank. The water resting in the main hot water pipes may have cooled towards environmental temperature and below a desired water temperature. Therefore, at least a portion of the cooled water resting in the main hot water pipes moves past the joint.

Additionally, fresh water from the hot water source moves through the main hot water pipes towards the toilet tank. The fresh water may but does not necessarily move past the joint. The fresh water may but does not necessarily reach the toilet tank.

One or more embodiments include receiving a user indication to turn on hot water at a hot water outlet (Operation 412). A user input element receives a user indication to turn on hot water at a hot water outlet. As an example, a hot water faucet is turned on. As another example, water is requested at a hot water inlet of a dishwasher.

One or more embodiments include passing water from the hot water source, through the joint, towards the hot water outlet (Operation 414). Responsive to turning on hot water at the hot water outlet, water is passed from the hot water source towards the hot water outlet.

Any water resting in the pipes between the joint and the hot water outlet exits the hot water outlet. The water resting in the pipes between the joint and the hot water outlet was not able to move towards the toilet tank at Operation 410. The water resting in the pipes between the joint and the hot water outlet may have cooled towards environmental temperature and below the desired water temperature.

If fresh water from the hot water source has not yet reached the joint at Operation 410, then any cooled water located in the main hot water pipes moves towards the hot water outlet and exits the hot water outlet. Then the fresh water that entered the main hot water pipes due to the toilet flushing moves through the joint towards the hot water outlet. The fresh water ultimately exits the hot water outlet.

If fresh water from the hot water source has reached the joint at Operation 410, then there is no cooled water in the main hot water pipes. The fresh water that entered the main hot water pipes due to the toilet flushing moves from the joint towards the hot water outlet. The fresh water ultimately exits the hot water outlet.

Additional fresh water from the hot water source also enters the main hot water pipes. The additional fresh water also moves towards the hot water outlet and may exit the hot water outlet.

According to the operations of FIG. 4, before Operation 410, a certain volume of cooled water may have been resting in the main hot water pipes. At Operation 410, at least a portion of the cooled water passes towards the toilet tank. At Operation 414, less than all of the cooled water that was resting in the main hot water pipes prior to Operation 410 moves towards and exits from the hot water faucet. Hence, a reduced amount of cooled water exits from the hot water faucet, resulting in a reduced amount of water wastage.

Figure 5:
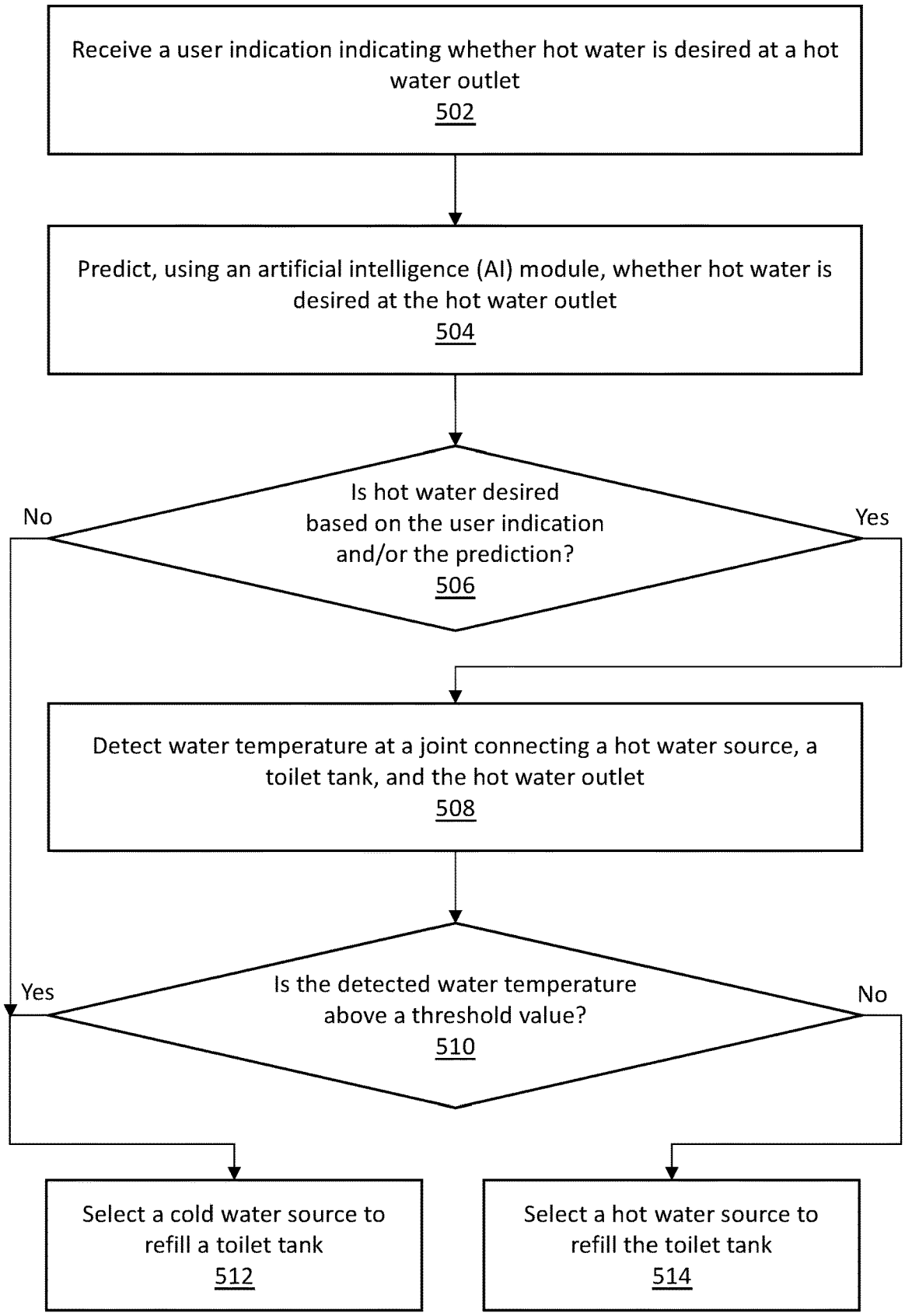
FIG. 5 illustrates an example set of operations for determining water levels from different sources for entry into a toilet tank, in accordance with one or more embodiments.

FIG. 5 illustrates an example set of operations for determining water levels from different sources for entry into a toilet tank, in accordance with one or more embodiments. One or more operations illustrated in FIG. 5 may be modified, rearranged, or omitted all together. Accordingly, the particular sequence of operations illustrated in FIG. 5 should not be construed as limiting the scope of one or more embodiments.

One or more embodiments include receiving a user indication indicating whether hot water is desired at a hot water outlet (Operation 502). If a user desires to use hot water at a hot water outlet within a critical time period, then the user inputs a user indication indicating that hot water is desired. As described above, a critical time period is a maximum duration of time in which fresh water that exited from a hot water source and rests in a set of pipes remains above a desired water temperature. In an embodiment, a user indication indicating that hot water is desired at a hot water outlet is a user indication indicating that a certain level of water for entry into the toilet tank from the hot water source is desired.

As an example, a user indication indicating that hot water is desired at a hot water outlet may indicate that all water for entry into the toilet tank should originate from the hot water source. As another example, a user indication indicating that hot water is desired at a hot water outlet may indicate that a certain percentage of water for entry into the toilet tank should originate from the hot water source, wherein the percentage of water from the hot water source is set such that fresh water entering the pipes due to the toilet flush reaches at least the joint connecting to the hot water outlet.

In an embodiment, a user input element receiving a user indication to flush a toilet at Operation 402 differs from a user input element receiving a user indication indicating whether hot water is desired at a hot water outlet. In another embodiment, a same user input element receives (a) a user indication to flush a toilet and (b) a user indication indicating whether hot water is desired at a hot water outlet.

One or more embodiments include predicting, using an artificial intelligence (AI) module, whether hot water is desired at the hot water outlet (Operation 504). An AI module predicts whether hot water is desired at the hot water outlet within a critical time period.

In an embodiment, an AI module predicts whether hot water is desired at the hot water outlet based on a current time. As an example, John may have a pattern of washing up at 7 a.m. daily. John may use hot water at a hot water faucet at the sink as part of his washing up routine. Based on the pattern, the AI module may predict that hot water is desired at 7 a.m. John may also have a pattern of showering at 8 p.m. daily. John may use hot water at a hot water faucet at the shower stall. Based on the pattern, the AI module may also predict that hot water is desired at 8 p.m.

One or more embodiments include determining whether hot water is desired based on the user indication and/or the prediction (Operation 506).

If neither the user indication received at Operation 502 nor the prediction determined at Operation 506 indicates that hot water is desired at the hot water outlet within a critical time period, then one or more embodiments include selecting a cold water source to refill a toilet tank (Operation 512). Based on the selection of the cold water source, the valve passes water from the cold water source towards the toilet tank at Operation 406.

If the user indication received at Operation 502 and/or the prediction determined at Operation 506 indicates that hot water is desired at the hot water outlet within a critical time period, then one or more embodiments include detecting a water temperature at a joint connecting a hot water source, a toilet tank, and the hot water outlet (Operation 508). A sensor located at a joint (or another location) detects a water temperature of water within the pipes.

One or more embodiments include determining whether the detected water temperature is above a threshold value (Operation 510). The detected water temperature is compared with a threshold value, which is the water temperature that is desired for water exiting a hot water outlet.

If the detected water temperature is above the threshold value, one or more embodiments include selecting a cold water source to refill the toilet tank (Operation 512). Based on the selection of the cold water source, the valve passes water from the cold water source towards the toilet tank at Operation 406.

If the detected water temperature is not above the threshold value, one or more embodiments include selecting a hot water source to refill the toilet tank (Operation 514). Based on the selection of the hot water source, the valve passes water from the hot water source towards the toilet tank at Operation 408.

Figure 6:
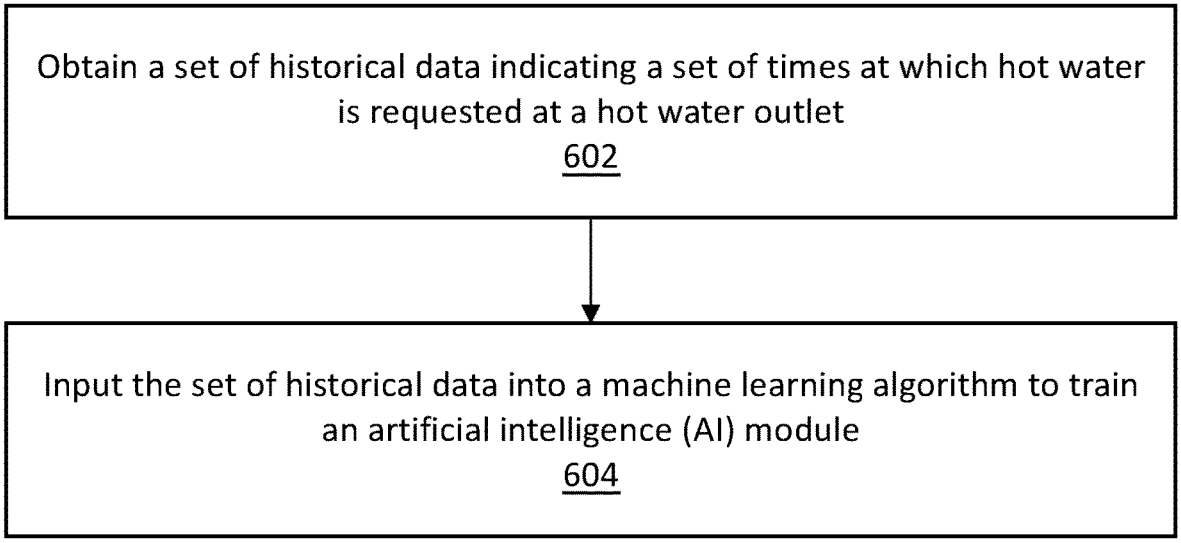
FIG. 6 illustrates an example set of operations for training an artificial intelligence (AI) module to predict desired water levels from different sources, in accordance with one or more embodiments.

FIG. 6 illustrates an example set of operations for training an artificial intelligence (AI) module to predict desired water levels from different sources, in accordance with one or more embodiments. One or more operations illustrated in FIG. 6 may be modified, rearranged, or omitted all together. Accordingly, the particular sequence of operations illustrated in FIG. 6 should not be construed as limiting the scope of one or more embodiments.

One or more embodiments include obtaining a set of historical data indicating a set of times at which hot water is requested at a hot water outlet (Operation 602). Historical requests for hot water at a hot water outlet are recorded and stored. As an example, on Monday, Joe may turn on a hot water faucet at 10:08 a.m. On the same day, Mary may turn on the hot water faucet at 10:15 a.m. On Tuesday, Joe may turn on the hot water faucet at 10:07 a.m. On the same day, Mary may turn on the hot water faucet at 10:20 a.m. A data repository may store historical data indicating that hot water was requested at the water faucet at Monday 10:08 a.m.; Monday 10:15 a.m.; Tuesday 10:07 a.m.; and Tuesday 10:20 a.m.

Optionally, additional historical data associated with a request for hot water at a hot water outlet may also be recorded. As an example, each time hot water is requested at a hot water outlet, a number of persons in a house may be recorded and stored. Each time hot water is requested at a hot water outlet, an environmental temperature may be recorded and stored.

The stored historical data becomes training data for training an AI module.

One or more embodiments include inputting the set of historical data into a machine learning algorithm to train an artificial intelligence (AI) module (Operation 604). The historical data is input into a machine learning algorithm. The machine learning algorithm generates an AI module that best fits the historical data. The output of the AI module is a prediction of whether hot water will be requested at the hot water outlet within a critical time period. The set of inputs to the AI module are the variables covered by the historical data.

As an example, a set of historical data may include time of each hot water request. The historical data may indicate that that hot water was requested at a faucet at Monday 10:08 a.m.; Monday 10:15 a.m.; Tuesday 10:07 a.m.; Tuesday 10:20 a.m.; Wednesday at 10:09 a.m.; and Wednesday at 10:17 a.m. The historical data may be used as training data to train an AI module. A machine learning algorithm may generate an AI module based on the training data. Based on the training data, the AI module may predict that hot water is desired at the faucet at daily 10:08 a.m. and 10:17 a.m.

As another example, variables covered by a set of historical data may include time of a hot water request, number of persons in the house at the time of the hot water request, and environmental temperature at the time of the hot water request. The historical data may be used as training data to train an AI module. A machine learning algorithm may generate an AI module based on the training data. The AI module is configured to predict whether hot water usage is expected within a critical time period based on (a) a current time, (b) number of persons currently in the house, and the current environmental temperature.

5. EXAMPLE EMBODIMENTS

A detailed example is described below for purposes of clarity. Components and/or operations described below should be understood as one specific example which may not be applicable to certain embodiments. Accordingly, components and/or operations described below should not be construed as limiting the scope of any of the claims.

In an example, Mary's house includes a plumbing system. The plumbing system includes a cold water source, a hot water source, a toilet, and a sink. The toilet has a tank for storing water to be used for flushing the toilet. The sink includes a sink faucet, which includes a mixer that combines water from the cold water source and water from the hot water source to provide warm water per request. The toilet and the sink are located in a bathroom.

The cold water source is connected to the toilet tank and a cold water inlet of the sink faucet through a set of pipes. In particular, a set of pipes (referred to as "main cold water pipes") runs from the cold water source to a joint located within the walls of the bathroom. A set of pipes runs from the joint to the toilet tank. A set of pipes runs from the joint to the sink faucet. Due to a physical distance between the cold water source and the bathroom, the main cold water pipes are longer than any of the sets of pipes between the joint and any of the toilet fixtures (such as, the toilet tank, and the sink faucet).

The hot water source is connected to the toilet tank and a hot water inlet of the sink faucet through a set of pipes. In particular, a set of pipes (referred to as "main hot water pipes") runs from the hot water source to a joint located within the walls of the bathroom. A set of pipes runs from the joint to the toilet tank. A set of pipes runs from the joint to the sink faucet. Due to a physical distance between the hot water source and the bathroom, the main hot water pipes are longer than any of the sets of pipes between the joint and any of the toilet fixtures (such as, the toilet tank, and the sink faucet).

The toilet includes a valve. The valve controls whether water for refilling the tank is (a) all taken from the cold water source, or (b) taken from both the cold water source and the hot water source. In particular, the tank holds 3 gallons of water. The main hot water pipes hold 2 gallons of water. Hence, the valve may pass 33% of water (1 gallon) from the cold water source and 66% of water (2 gallons) from the hot water source. Having passed 2 gallons of water from the hot water source towards the toilet tank, all water resting in the main hot water pipes before a toilet flush would have passed through the joint. Hence, fresh water from the hot water source would have reached the joint, ready to flow towards the sink faucet per request.

The toilet includes a rotatable handle. If the handle is rotated to the left, the toilet is flushed, and water for refilling the toilet tank is all taken from the cold water source. If the handle is rotated to the right, the toilet is flushed, and 33% of water is taken from the cold water source and 66% of water is taken from the hot water source.

Mary has a morning routine of using the toilet and washing her face. After using the toilet, she flushes the toilet. Then she washes her face with warm water from the sink faucet at the sink.

On a certain morning, Mary wakes up and proceeds to conduct her morning routine. Before Mary requests any water (at the toilet, or the sink), the main hot water pipes hold cooled water. After using the toilet, she knows that she will next wash her face, requiring warm water at the sink faucet. Hence, she turns the rotatable handle of the toilet to the right. The valve in the toilet is set to pass 33% of water from the cold water source and 66% of water from the hot water source. The toilet is flushed. As water refills the toilet tank, water passes from the hot water source through the joint that also connects to the sink faucet.

Refilling the toilet tank includes: (a) passing the cooled water resting in the main hot water pipes towards the toilet tank, and (b) taking fresh water from the hot water source into the main hot water pipes and passing the fresh water towards the toilet tank. At the end of filling the toilet tank, the main hot water pipes no longer hold any cooled water, but instead hold fresh water from the hot water source.

Mary then turns on the sink faucet for warm water. At first, water resting in the pipes between the joint and the hot water inlet of the sink faucet exits the sink faucet. Next, water in the main hot water pipes at the end of filling the toilet tank reaches the hot water inlet. The water had entered the main hot water pipes due to the toilet flushing just moments ago, and hence remains above the desired water temperature. Therefore, after Mary turned on the sink faucet, she did not need to wait for fresh water to fill the main hot water pipes. She did not need to waste any cooled water in the main hot water pipes before obtaining warm water at the sink faucet.

Additionally, Mary's bathroom includes a shower stall. The shower stall includes a shower faucet, which includes a mixer that combines water from the cold water source and water from the hot water source to provide warm water per request. A set of pipes runs from the joint to the shower faucet.

Mary has an evening routine of using the toilet and taking a shower. After using the toilet, she flushes the toilet. Then she showers using warm water.

On a certain evening, Mary proceeds to conduct her evening routine. Before Mary requests any water (at the toilet, the sink, or the shower stall), the main hot water pipes hold cooled water. After using the toilet, she knows that she will next shower, requiring warm water at the shower stall. Hence, she turns the rotatable handle of the toilet to the right. The valve in the toilet is set to pass 33% of water from the cold water source and 66% of water from the hot water source. The toilet is flushed. As water refills the toilet tank, water passes from the hot water source through the joint that also connects to the shower faucet.

Before the toilet tank is full, Mary turns on the shower faucet. At this time, only a portion of the cooled water resting in the main hot water pipes has moved passed the joint. A remainder of the cooled water is still within the main hot water pipes. Meanwhile, fresh water from the hot water source reaches a particular location along the main hot water pipes.

When the shower faucet is turned on, water moves from the main hot water pipes, through the joint, towards both the toilet tank and the shower faucet. At first, water resting in the pipes between the joint and the hot water inlet of the shower faucet exits the shower faucet. Next, cooled water between the particular location and the joint exits the shower faucet. Next, fresh water that entered the main hot water pipes due to the toilet flushing exits the shower faucet. Therefore, less than the entire volume of cooled water resting in the main hot water pipes needed to exit the shower faucet before water above the desired water temperature reached the shower faucet. An amount of cooled water wasted at the shower faucet is reduced.

6. HARDWARE OVERVIEW

According to one embodiment, the techniques described herein are implemented by one or more special-purpose computing devices. The special-purpose computing devices may be hard-wired to perform the techniques, or may include digital electronic devices such as one or more application-specific integrated circuits (ASICs), field programmable gate arrays (FPGAs), or network processing units (NPUs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, FPGAs, or NPUs with custom programming to accomplish the techniques. The special-purpose computing devices may be desktop computer systems, portable computer systems, handheld devices, networking devices or any other device that incorporates hard-wired and/or program logic to implement the techniques.

Figure 7:
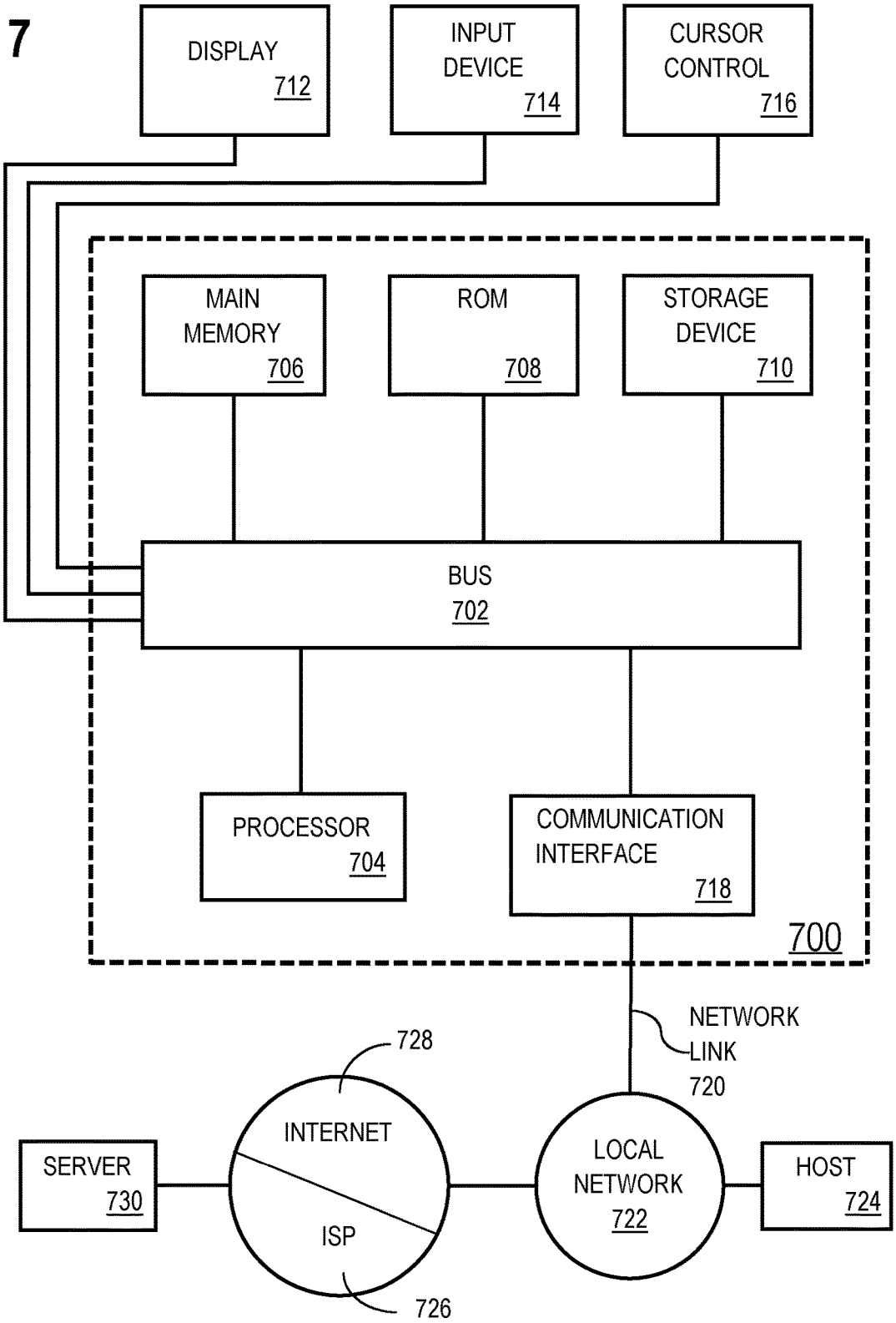
FIG. 7 shows a block diagram that illustrates a computer system, in accordance with one or more embodiments.

For example, FIG. 7 is a block diagram that illustrates a computer system 700 upon which an embodiment of the invention may be implemented. Computer system 700 includes a bus 702 or other communication mechanism for communicating information, and a hardware processor 704 coupled with bus 702 for processing information. Hardware processor 704 may be, for example, a general purpose microprocessor.

Computer system 700 also includes a main memory 706, such as a random access memory (RAM) or other dynamic storage device, coupled to bus 702 for storing information and instructions to be executed by processor 704. Main memory 706 also may be used for storing temporary variables or other intermediate information during execution of instructions to be executed by processor 704. Such instructions, when stored in non-transitory storage media accessible to processor 704, render computer system 700 into a special-purpose machine that is customized to perform the operations specified in the instructions.

Computer system 700 further includes a read only memory (ROM) 708 or other static storage device coupled to bus 702 for storing static information and instructions for processor 704. A storage device 710, such as a magnetic disk or optical disk, is provided and coupled to bus 702 for storing information and instructions.

Computer system 700 may be coupled via bus 702 to a display 712, such as a cathode ray tube (CRT), for displaying information to a computer user. An input device 714, including alphanumeric and other keys, is coupled to bus 702 for communicating information and command selections to processor 704. Another type of user input device is cursor control 716, such as a mouse, a trackball, or cursor direction keys for communicating direction information and command selections to processor 704 and for controlling cursor movement on display 712. This input device typically has two degrees of freedom in two axes, a first axis (e.g., x) and a second axis (e.g., y), that allows the device to specify positions in a plane.

Computer system 700 may implement the techniques described herein using customized hard-wired logic, one or more ASICs or FPGAs, firmware and/or program logic which in combination with the computer system causes or programs computer system 700 to be a special-purpose machine. According to one embodiment, the techniques herein are performed by computer system 700 in response to processor 704 executing one or more sequences of one or more instructions contained in main memory 706. Such instructions may be read into main memory 706 from another storage medium, such as storage device 710. Execution of the sequences of instructions contained in main memory 706 causes processor 704 to perform the process steps described herein. In alternative embodiments, hard-wired circuitry may be used in place of or in combination with software instructions.

The term "storage media" as used herein refers to any non-transitory media that store data and/or instructions that cause a machine to operate in a specific fashion. Such storage media may comprise non-volatile media and/or volatile media. Non-volatile media includes, for example, optical or magnetic disks, such as storage device 710. Volatile media includes dynamic memory, such as main memory 706. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge, content-addressable memory (CAM), and ternary content-addressable memory (TCAM).

Storage media is distinct from but may be used in conjunction with transmission media. Transmission media participates in transferring information between storage media. For example, transmission media includes coaxial cables, copper wire and fiber optics, including the wires that comprise bus 702. Transmission media can also take the form of acoustic or light waves, such as those generated during radio-wave and infra-red data communications.

Various forms of media may be involved in carrying one or more sequences of one or more instructions to processor 704 for execution. For example, the instructions may initially be carried on a magnetic disk or solid state drive of a remote computer. The remote computer can load the instructions into its dynamic memory and send the instructions over a telephone line using a modem. A modem local to computer system 700 can receive the data on the telephone line and use an infra-red transmitter to convert the data to an infra-red signal. An infra-red detector can receive the data carried in the infra-red signal and appropriate circuitry can place the data on bus 702. Bus 702 carries the data to main memory 706, from which processor 704 retrieves and executes the instructions. The instructions received by main memory 706 may optionally be stored on storage device 710 either before or after execution by processor 704.

Computer system 700 also includes a communication interface 718 coupled to bus 702. Communication interface 718 provides a two-way data communication coupling to a network link 720 that is connected to a local network 722. For example, communication interface 718 may be an integrated services digital network (ISDN) card, cable modem, satellite modem, or a modem to provide a data communication connection to a corresponding type of telephone line. As another example, communication interface 718 may be a local area network (LAN) card to provide a data communication connection to a compatible LAN. Wireless links may also be implemented. In any such implementation, communication interface 718 sends and receives electrical, electromagnetic or optical signals that carry digital data streams representing various types of information.

Network link 720 typically provides data communication through one or more networks to other data devices. For example, network link 720 may provide a connection through local network 722 to a host computer 724 or to data equipment operated by an Internet Service Provider (ISP) 726. ISP 726 in turn provides data communication services through the world wide packet data communication network now commonly referred to as the "Internet" 728. Local network 722 and Internet 728 both use electrical, electromagnetic or optical signals that carry digital data streams. The signals through the various networks and the signals on network link 720 and through communication interface 718, which carry the digital data to and from computer system 700, are example forms of transmission media.

Computer system 700 can send messages and receive data, including program code, through the network(s), network link 720 and communication interface 718. In the Internet example, a server 730 might transmit a requested code for an application program through Internet 728, ISP 726, local network 722 and communication interface 718.

The received code may be executed by processor 704 as it is received, and/or stored in storage device 710, or other non-volatile storage for later execution.

7. MISCELLANEOUS; EXTENSIONS

Embodiments are directed to a system with one or more devices that include a hardware processor and that are configured to perform any of the operations described herein and/or recited in any of the claims below.

In an embodiment, a non-transitory computer readable storage medium comprises instructions which, when executed by one or more hardware processors, causes performance of any of the operations described herein and/or recited in any of the claims.

Any combination of the features and functionalities described herein may be used in accordance with one or more embodiments. In the foregoing specification, embodiments have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. A system, including:

a hot water source;

a toilet tank of a toilet, wherein the toilet tank is configured to hold water for flushing the toilet;

a hot water outlet;

a joint, directly or indirectly, connected to at least (a) the hot water source, (b) the toilet tank, and (c) the hot water outlet;

wherein the joint is configured to pass water from the hot water source towards at least the toilet tank and the hot water outlet.

2. The system of claim 1, further including:

a first set of pipes connecting the joint and the hot water source;

a second set of pipes connecting the joint and the toilet tank;

a third set of pipes connecting the joint and the hot water outlet.

3. The system of claim 1, further including:

a valve, directly or indirectly, connected to (a) the toilet tank, (b) the joint that is connected to at least the hot water source, and (c) a cold water source;

wherein the valve is configured to control a first level of water flowing towards the toilet tank to be from the hot water source and a second level of water flowing towards the toilet tank to be from the cold water source.

4. The system of claim 3, further including:

a user input element configured to receive:

(a) a first user indication indicating whether to flush the toilet; and (b) a second user indication indicating whether water from the hot water outlet is requested;

wherein the valve is configured to control the first level of water flowing towards the toilet tank from the hot water source and the second level of water flowing towards the toilet tank from the cold water source based on the second user indication received by the control.

5. The system of claim 3, further including:

an artificial intelligence (AI) module configured to determine a prediction of whether water is desired from the hot water outlet;

wherein the valve is configured to control the first level of water flowing towards the toilet tank from the hot water source and the second level of water flowing towards the toilet tank from the cold water source based on the prediction determined by the AI module.

6. The system of claim 3, further including:

a sensor configured to detect a water temperature at a particular location along a set of plumbing components connecting the hot water source and the toilet tank;

wherein the valve is configured to control the first level of water flowing towards the toilet tank from the hot water source and the second level of water flowing towards the toilet tank from the cold water source based on a comparison of the water temperature against a threshold value.

7. The system of claim 6, wherein the particular location is one of the joint, the valve, and the toilet tank.

8. The system of claim 1, wherein the joint is located closer to the hot water outlet than the hot water source.

9. The system of claim 1, wherein the joint does not pass water towards the hot water source.

10. The system of claim 1, further comprising:

a second hot water outlet;

wherein the joint is, directly or indirectly, connected to (a) the hot water source, (b) the toilet tank, (c) the hot water outlet, and (d) the second hot water outlet;

wherein the joint is configured to pass water from the hot water source towards the toilet tank, the hot water outlet, and the second hot water outlet.

11. The system of claim 1, further comprising:

a second hot water outlet;

wherein a second joint is, directly or indirectly, connected to (a) the hot water source, (b) the toilet tank, and (c) the second hot water outlet;

wherein the second joint is configured to pass water from the hot water source towards the toilet tank and the second hot water outlet.

12. A toilet, including:

a toilet tank, wherein the toilet tank is configured to hold water for flushing the toilet;

a valve, directly or indirectly, connected to (a) the toilet tank, (b) a hot water source, and (c) a cold water source;

wherein the valve is configured to control at least one of a first level of water flowing towards the toilet tank from the hot water source and a second level of water flowing towards the toilet tank from the cold water source.

13. The toilet of claim 12, further including:

a user input element configured to receive from a user:

(a) a first user indication indicating whether to flush the toilet; and (b) a second user indication indicating at least one of a first desired level of water flowing towards the toilet tank from the hot water source and a second desired level of water flowing towards the toilet tank from the cold water source;

wherein the valve is configured to control the at least one of the first level of water flowing towards the toilet tank from the hot water source and the second level of water flowing towards the toilet tank from the cold water source based on the second user indication received by the control.

14. The toilet of claim 12, further including:

a temperature sensor configured to detect a water temperature;

wherein the valve is configured to control the at least one of the first level of water flowing towards the toilet tank from the hot water source and the second level of water flowing towards the toilet tank from the cold water source based on the water temperature.

15. A method, including:

passing, through a joint, a first volume of water from a hot water source towards a toilet tank of a toilet, wherein the toilet tank is configured to hold water for flushing the toilet;

passing, through the joint, a second volume of water from the hot water source towards a hot water outlet.

16. The method of claim 15, wherein:

a first set of pipes connects the hot water source and a joint, a second set of pipes connects the joint and the toilet tank, and a third set of pipes connects the joint and the hot water outlet;

prior to passing the first volume of water from the hot water source towards the toilet tank, the first set of pipes holds a third volume of water that has cooled towards environmental temperature and below a threshold value;

passing the first volume of water from the hot water source towards the toilet tank comprises passing at least a portion of the third volume of water towards the toilet tank;

passing the second volume of water from the hot water source towards the hot water outlet comprises passing less than all of the third volume of water towards the hot water outlet.

17. The method of claim 15, wherein the first volume of water passed from the hot water source towards the toilet tank comprises water that has cooled towards environmental temperature and below a threshold value.

18. The method of claim 15, further including:

passing, through a valve, the first volume of water from the hot water source towards the toilet tank of the toilet;

wherein the valve is configured to control at least one of a first level of water flowing towards the toilet tank from the hot water source and a second level of water flowing towards the toilet tank from a cold water source.

19. The method of claim 15 wherein the toilet tank and the hot water outlet are located in a same physical environment.

20. The method of claim 15 wherein the toilet tank and the hot water outlet are located in a same bathroom.

* * * * *